United States Patent [19]

Logas

[11] Patent Number: 4,756,566

[45] Date of Patent: Jul. 12, 1988

[54] HIGH MECHANICAL ADVANTAGE ELECTRICAL RELEASE STRIKE

[75] Inventor: Duane K. Logas, San Bernardino, Calif.

[73] Assignee: Adams Rite Manufacturing Co., City of Industry, Calif.

[21] Appl. No.: 46,115

[22] Filed: May 5, 1987

[51] Int. Cl.[4] ..... E05C 21/00

[52] U.S. Cl. ..... 292/341.16

[58] Field of Search ..... 292/341.16, 201, 144

[56] References Cited

U.S. PATENT DOCUMENTS

| | | | |
|---|---|---|---|
| 420,834 | 2/1890 | Seib | 292/341.16 |
| 3,122,388 | 2/1964 | Powers | 292/341.16 |
| 3,638,984 | 2/1972 | Davidson | 292/201 X |
| 3,861,727 | 1/1975 | Froerup et al. | 292/341.16 |
| 4,626,010 | 12/1986 | Hanchetl, Jr. et al. | 292/341.16 |

*Primary Examiner*—Richard E. Moore

*Attorney, Agent, or Firm*—William W. Haefliger

[57] ABSTRACT

A release strike assembly, comprises:

a strike bolt is pivotally mounted by a case to swing between extended and retracted positions, and a spring yieldably urges the bolt toward its extended position. First and second latch elements cooperate with one another, in pivoting, and the first latch element blocks the bolt against swinging toward retracted position when the first latch element is in its first position. The first latch element also has a second position in which it allows the bolt to swing toward its extended position. An actuator pivots one of the latch elements, a second latch element pivotally supported for swinging movement within the case between primary and secondary positions, the second latch coupled to the first latch element to pivot with the first latch element, and an actuator to effect pivoting of one of the latch elements.

11 Claims, 2 Drawing Sheets

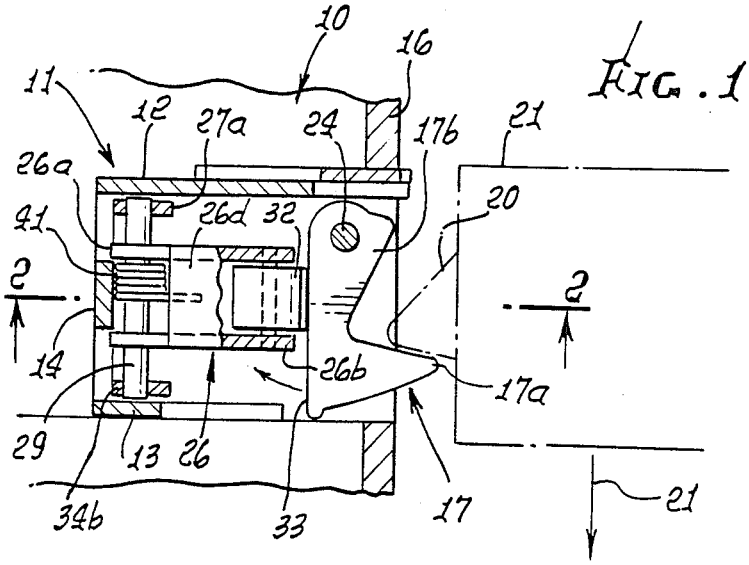
FIG. 1.
FIG. 2.
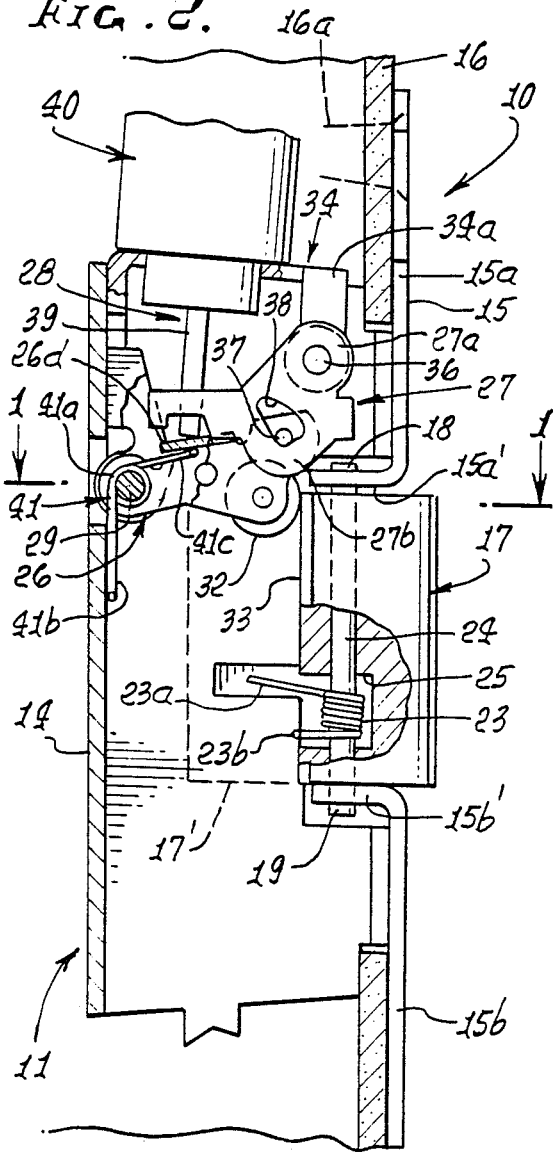
FIG. 3.
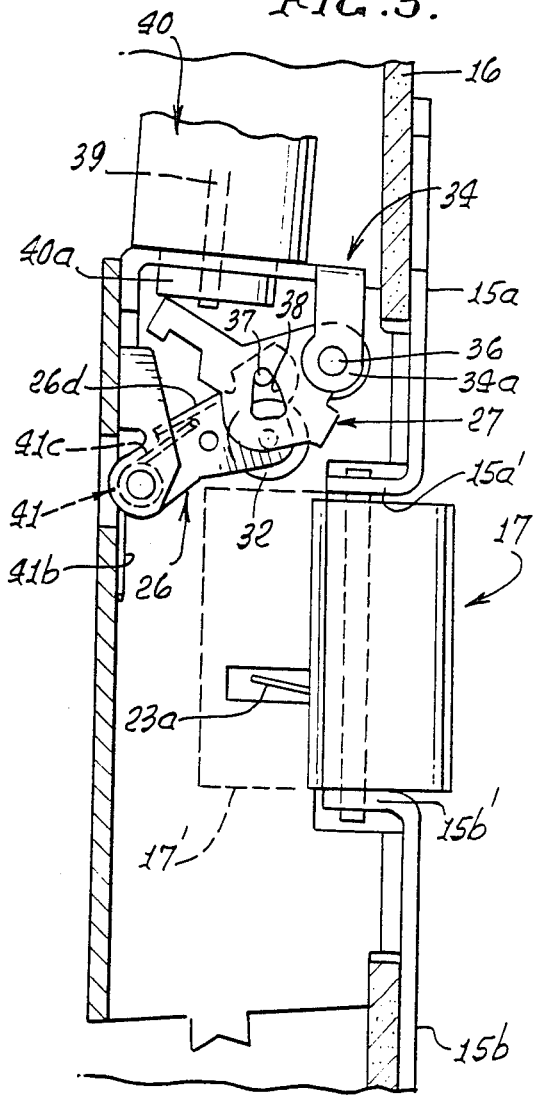

HIGH MECHANICAL ADVANTAGE ELECTRICAL RELEASE STRIKE

BACKGROUND OF THE INVENTION

This invention relates generally to latches, and more particularly latch mechanisms transmitting actuating movement to strike bolts.

Devices heretofore available for the purpose described herein embody inherent undesirable features which not only present potential sources of trouble, but also make them more difficult to install and maintain in good operating condition.

For example, in one known embodiment, the casing structure and strike plate are permanently connected, and the strike plate also functions as a faceplate. In such a construction, the faceplate portion cannot be varied to meet different aesthetic decorative effects.

In different localities, it is desirable to change the electric actuating coil of the device, for example, to operate under different voltages, or to replace a coil which has failed. In the conventional device noted above, the coil is mounted within the housing or casing of the device, which renders its accessibility difficult.

The device of U.S. Pat. No. 3,638,984 constitutes one solution to the above problem; however, in certain applications there is need for a substantially increased mechanical advantage of motion transmission between the electrical actuator and the strike bolt, within a highly compact assembly; also there is need for an improved, highly compact, basic mechanism adaptable to blocking retraction of a strike bolt, either by operation of a solenoid acting upon a blocking element, or by operation of a torsion spring acting upon the blocking element, thereby facilitating production of essentially the same basic mechanism for operation in either of such modes.

BRIEF SUMMARY OF THE INVENTION

It is a major object of the invention to provide a significantly improved device, meeting the above need. Basically, the release strike assembly of the invention comprises:

A strike bolt is pivotally mounted by a case to swing between extended and retracted positions, and a spring yieldably urges the bolt toward its extended position. First and second latch elements cooperate with one another, in pivoting, and the first latch element blocks the bolt against swinging toward retracting position when the first latch element is in its first position. The first latch element also has a second position in which it allows the bolt to swing toward its extended position. An actuator pivots one of the latch elements.

It is a further object of the invention to provide a second spring urging one of said latch elements in a pivotal direction. In one form of the device, the second spring urges the first latch element toward its second position; and the second latch element is then pivoted in offset relation to pivoting of the first latch element, so that the second latch element pivots counterclockwise toward its primary position as the first latch element is pivoted clockwise toward its first position; further, the second latch element allows the first latch element to pivot counterclockwise toward its second position as the second latch element pivots clockwise toward its secondary position. In this regard, the actuating means may be coupled to the first latch element to push the first latch element toward its first position, thereby causing the second latch element to pivot toward its primary position; and the actuating means may comprise a solenoid having a plunger extending within the case past the second latch element to push a crank arm portion of the first latch element, and a highly compact assembly is thereby provided.

In another form of the device, the second spring urges the second latch element toward its primary position so as to urge the first latch element toward its first position. The actuating means may then be coupled to the second latch element to pull the second latch element toward its secondary position, thereby causing the first latch element to pivot toward its second position; and the actuating means may, again, comprise a solenoid actuating a crank arm portion of the second latch element.

In yet another form of the device, the actuating means is coupled to the second latch element to pull the second latch element toward its primary position, thereby causing the first latch element to pivot toward its first position.

These and other objects and advantages of the invention, as well as the details of an illustrative embodiment, will be more fully understood from the following specification and drawings, in which:

DRAWING DESCRIPTION

FIG. 1 is a section through one form of the device, on lines 1—1 of FIG. 2;

FIG. 2 is a side elevation taken in section on lines 2—2 of FIG. 1, and showing two latch elements in strike bolt extended position;

FIG. 3 is a view like FIG. 2, showing the latch elements in position allowing the bolt to retract;

DETAILED DESCRIPTION

Figure 4:
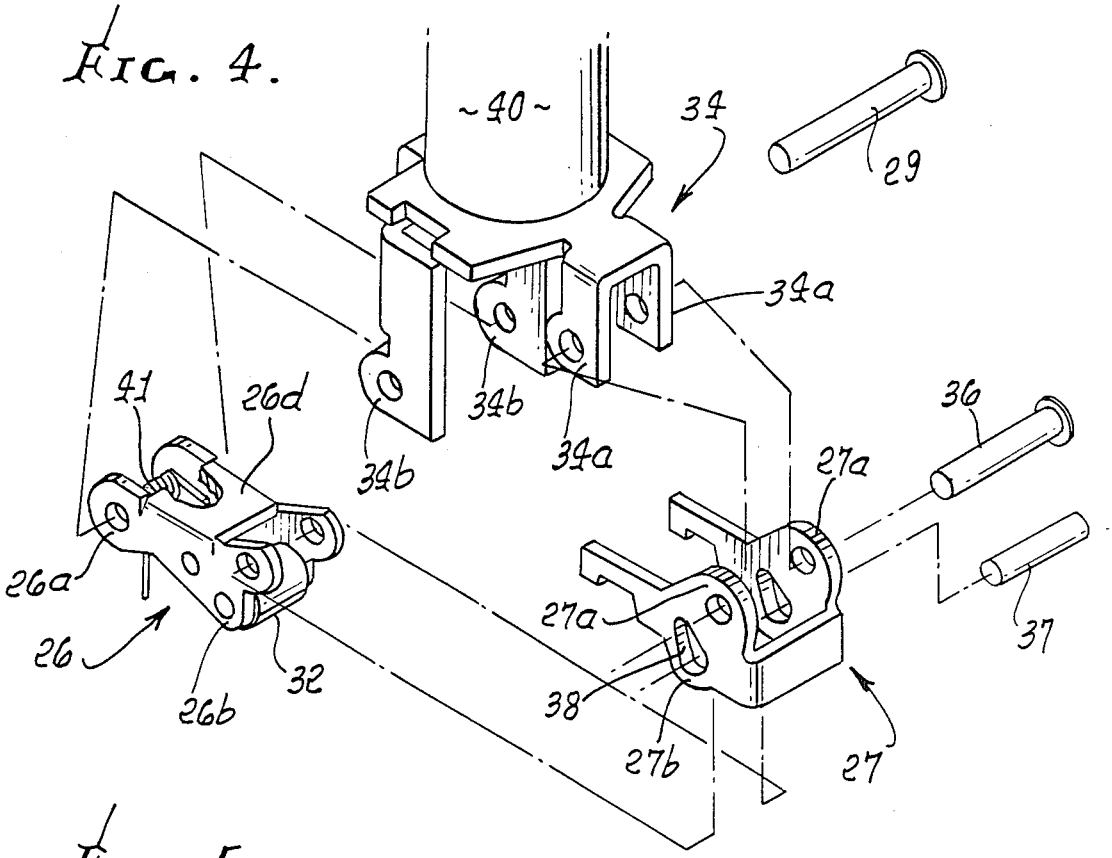
FIG. 4 is an exploded view of the elements of Figs. 1–3, and an associated solenoid connecting structure.

In FIGS. 1–6, the strike unit or assembly 10 includes a metal case 11 having opposite side walls 12 and 13, and opposite end walls 14 and 15. Wall 15 includes arms **15*a* and 15*b* extending vertically oppositely to attach to jamb section 16 as via fastener 16*a*. The walls are appropriately joined together, to define an integral case. Arms 15*a* and 15*b* are bent inward to define inward extensions 15*a*′ and 15*b*′ spaced apart vertically, to define a space therebetween receiving a strike bolt 17. That bolt is pivotally mounted at 18 and 19 to the extensions 15*a*′ and 15*b*′, so as to swing about a vertical axis between an extended position seen in full lines, and a retracted position seen in broken lines 17′. A pivot pin appears at 24**.

In extended position, the hook **17*a* of the bolt 17 overlaps a part 20 in the door 21 to prevent swinging of the door in direction 21, indicated in FIG. 1. In inwardly swung retracted bolt position 17′ the overlap of the hook 17*a* and part 20 is removed, so that the door can swing in direction 21. Leg 17*b* of the bolt 17 carries pin 24, and a torsion spring 23 urges the bolt toward extended position 17′. That spring has leg 23*a* bearing against wall 12, and leg 23*b* bearing against the bolt body, the spring being wound about pin 24 in a recess 25** in the bolt.

In accordance with an important object of the invention, dual latch elements are provided to allow the device to operate in different modes in conjunction with an actuator solenoid, as represented at 40. For this purpose, the following are provided:

(a) a first latch element, as at 26 for example, pivotally supported for swinging movement within the case between first and second positions, the first element in its first position (see FIG. 2) blocking the bolt against swinging toward its retracted position and in its second position (see FIG. 3) allowing the bolt to swing toward its retracted position, and (b) a second latch element, as at 27 for example, pivotally supported for swinging movement within the case between primary and secondary positions, the second latch coupled to the first latch element to pivot with the first latch element.

Further, actuating means is provided, as at 28, to effect pivoting of one of the latching elements, as referred to.

More specifically, the first latch element 26 may take the form as shown, including a latch arm which is channel shaped, and has webs at one end 26*a* pivotally connected to fixed lugs 34*b* of a bracket 34, as via a pivot pin 29. In down position as seen in FIG. 2, a roller 32 carried by webs at the opposite end 26*b* of the arm 26 engages the rearward facing vertical wall 33 of the bolt, to block its retraction.

The second latch element 27 also is channel shaped and located generally above arm 26. Element 27 is in the form of an arm having webs at one end 27*a* pivotally connected to downwardly projecting walls 34*a* of the bracket 34. See pivot pin 36. Element 27 is coupled to arm 26 via a lost motion connection comprising pin 37 on arm 26 projecting into larger cut-outs 38 in the side webs 27*b* of element 27. Element 27 projects further to the left in FIGS. 2 and 3, i.e. further from pivot 36 than the lost motion connection, to engage the stop surface 40*a*, in the pivoted positions seen in FIG. 3. Surface 40*a* is associated with the actuator such as solenoid 40, having a plunger 39 which pushes on the top web 26*d* of element 26, as seen in FIG. 2. Therefore, such downward force is exerted on arm 26, moving it to FIG. 2 position when the solenoid is energized. When the solenoid is de-energized and plunger 39 is retracted, a torsion spring 41 acting on arm 26, returns it upwardly (counterclockwise), and element 27 is pivoted clockwise upwardly, as in FIG. 3. Spring 41 has windings 41*a* about pivot pin 29, an arm 41*b* engaging wall 14, and an arm 41*c* engaging the web 26*d* of arm 26. Side webs 27*b* of arm element 27 engage the casing wall turned portion 15*a*' to limit downward displacement rotation of 26 and 27. See FIG. 2.

Figure 5:
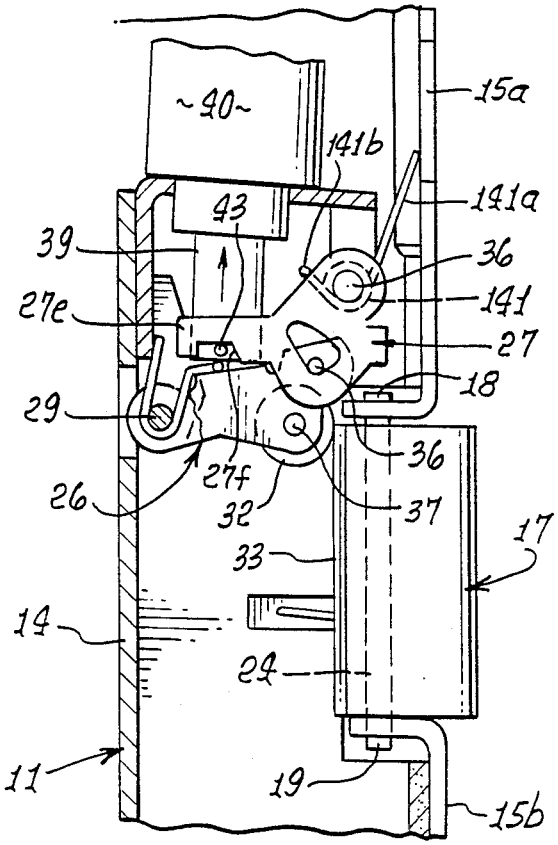
FIG. 5 is a view like FIG. 2, showing a first modification.

In FIG. 5 the construction is the same, except that a torsion spring 141 is provided on pivot pin 36. On leg 141*a* engages wall 15*a*, and the other leg 141b engages the element 27 to urge it downwardly i.e. counterclockwise. Thus, in solenoid de-energized condition, the parts 26 and 27 are in down position, as in FIG. 2. In solenoid energized condition, the enlarged diameter plunger 39 pulls upwardly on the extent 27*e* of the element 27 (see pin 43 on the plunger hooked under edge 27*f* of the extent 27*e*), to raise the arms 26 and 27 to FIG. 3 positions, with mechanical advantage. Such similarity of construction of the device as seen in FIG. 2 and 5 facilitates its production for use in different installations, one where downward "push" of the solenoid plunger is required, and the other where upward "pull" of the plunger is required.

Figure 6:
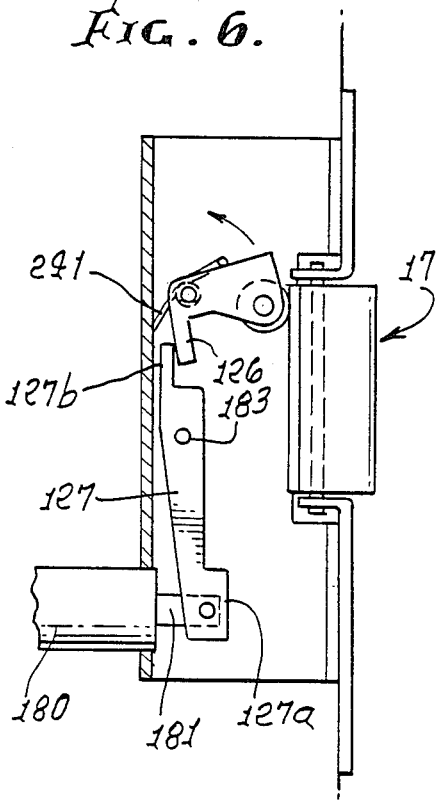
FIG. 6 is a view like FIG. 2, showing a second modification.

In FIG. 6, the arms 126 and 127 correspond to arms 26 and 27, and spring 241 corresponds to torsion spring 41. When the solenoid 180 is energized, plunger 181 pivots lower extent 127*a* of arm 127 to the left, so that the upper extent 127*b* of the arm, above pivot 183, rotates to the right engaging arm 126 and pivoting it counterclockwise, i.e. free of the bolt 17. When the solenoid is de-energized, spring 241 returns arm 26 to down position, to block retraction of the bolt.

I claim:

1. A release strike assembly, comprising:

(a) a case having a side opening, (b) a strike blt pivotally supported by the case to swing between extended and retracted positions relative to the case, (c) a first spring yieldably urging the bolt toward extended position, (d) a first latch element pivotally connected to and supported by the case at one pivot location for swinging movement within the case between first and second positions, the first latch element in its first position blocking the bolt against swinging toward its retracted position and in its second position allowing the bolt to swing toward its extended position, and (e) a second latch element pivotally connected to and supported by the case at another pivot location spaced from said one location for swinging movement within the case between primary and secondary positions, the second latch element coupled to the first latch element to pivot with the first latch element, and in opposite rotary sense relative thereto, at such location.

(f) and actuating means to effect pivoting of one of the latch elements.

2. The assembly of claim 1 including a second spring operatively coupled to one of said latch elements for urging said one of said latch elements in a pivotal direction.

3. The assemlby of claim 2 wherein said second spring urges the first latch element toward its second position.

4. The assembly of claim 2 wherein the second spring is operatively coupled to the second latch element for urging the second latch element toward its primary position so as to thereby cause the second latch element to urge the first latch element toward its first position.

5. The assembly of claim 3 wherein the second latch element is pivoted to the case, in offset relation to pivoting of the first latch element, so that the second latch element pivots counterclockwise toward its primary position as the first latch element is pivoted clockwise toward its first position, and the second latch element allows the first latch element to pivot counterclockwise toward its second position as the second latch element pivots clockwise toward its secondary position.

6. The assembly of claim 3 wherein the actuating means is coupled to the first latch element to push the first latch element toward its first position, thereby causing the second latch element to pivot toward its primary position.

7. The assembly of claim 6 wherein the actuating means comprises a solenoid having a plunger extending within the case to push a crank arm portion of the first latch element.

8. The assembly of claim 4 wherein the actuating means is coupled to the second latch element to pull the second latch element toward its secondary position, thereby causing the first latch element to pivot toward its second position.

9. The assembly of claim 8 wherein the actuating means comprises a solenoid having a plunger extending within the case to pull a crank arm portion of the second latch element which extends between the plunger and the first latch element.

10. The assembly of claim 3 wherein the actuating means is coupled to the second latch element to pull the second latch element toward its primary position, thereby causing the first latch element to pivot toward its first position.

11. The assembly of claim 10 wherein the actuating means commprises a solenoid having a plunger extending within the case to pull a crank arm portion of the second latch element.

* * * * *